United States Patent [19]

Dean et al.

[11] Patent Number: 4,791,338

[45] Date of Patent: Dec. 13, 1988

[54] FLUORESCENT LAMP CIRCUIT WITH REGULATION RESPONSIVE TO VOLTAGE, CURRENT, AND PHASE OF LOAD

[75] Inventors: Thomas E. Dean, Cookeville; William H. Henrich, Sparta, both of Tenn.

[73] Assignee: Thomas Industries, Inc., Del.

[21] Appl. No.: 878,819

[22] Filed: Jun. 26, 1986

[51] Int. Cl.[4] ..... H05B 41/24; H05B 41/392; H05B 41/233

[52] U.S. Cl. ..... 315/174; 315/176; 315/278; 315/287; 315/209 R; 315/DIG. 4; 315/DIG. 7; 315/307; 315/102; 315/308

[58] Field of Search ..... 315/306, 307, 308, 194, 315/DIG. 2, DIG. 5, DIG. 7, 175, 174, 176, 200 R, 209 R, 323, 102

[56] References Cited

U.S. PATENT DOCUMENTS

| | | | |
|---|---|---|---|
| 4,004,187 | 1/1977 | Walker | 315/DIG. 7 |
| 4,004,188 | 1/1977 | Cooper | 315/DIG. 7 |
| 4,234,822 | 11/1980 | Garrison et al. | 315/DIG. 7 |
| 4,327,309 | 4/1982 | Wallot | 315/DIG. 5 |
| 4,358,716 | 11/1982 | Cordes et al. | 315/DIG. 7 |
| 4,477,748 | 10/1984 | Grubbs | 315/306 |
| 4,525,648 | 6/1985 | De Bijl et al. | 315/DIG. 2 |
| 4,585,974 | 4/1986 | Stupp et al. | 315/DIG. 5 |

*Primary Examiner*—David K. Moore
*Assistant Examiner*—Mark R. Powell
*Attorney, Agent, or Firm*—Hill, Van Santen, Steadman & Simpson

[57] ABSTRACT

In a fluorescent lamp, a "soft" start-up circuit initially applies a lamp, or inter-electrode, voltage which is limited to a peak voltage that will not start the lamp prior to heating of the lamp cathode to the proper temperature. The lamp cathode is then heated to the proper start-up temperature after which the lamp voltage is increased to a value well in excess of the ignition voltage required for all lamp types and operating characteristics in initiating lamp operation. The increased lamp voltage is applied in a pulsed manner until the lamp is ignited, whereupon the lamp may be operated at normal lamp current and cathode voltages or the lamp filaments may even be turned off with a consequent savings in input power.

12 Claims, 2 Drawing Sheets

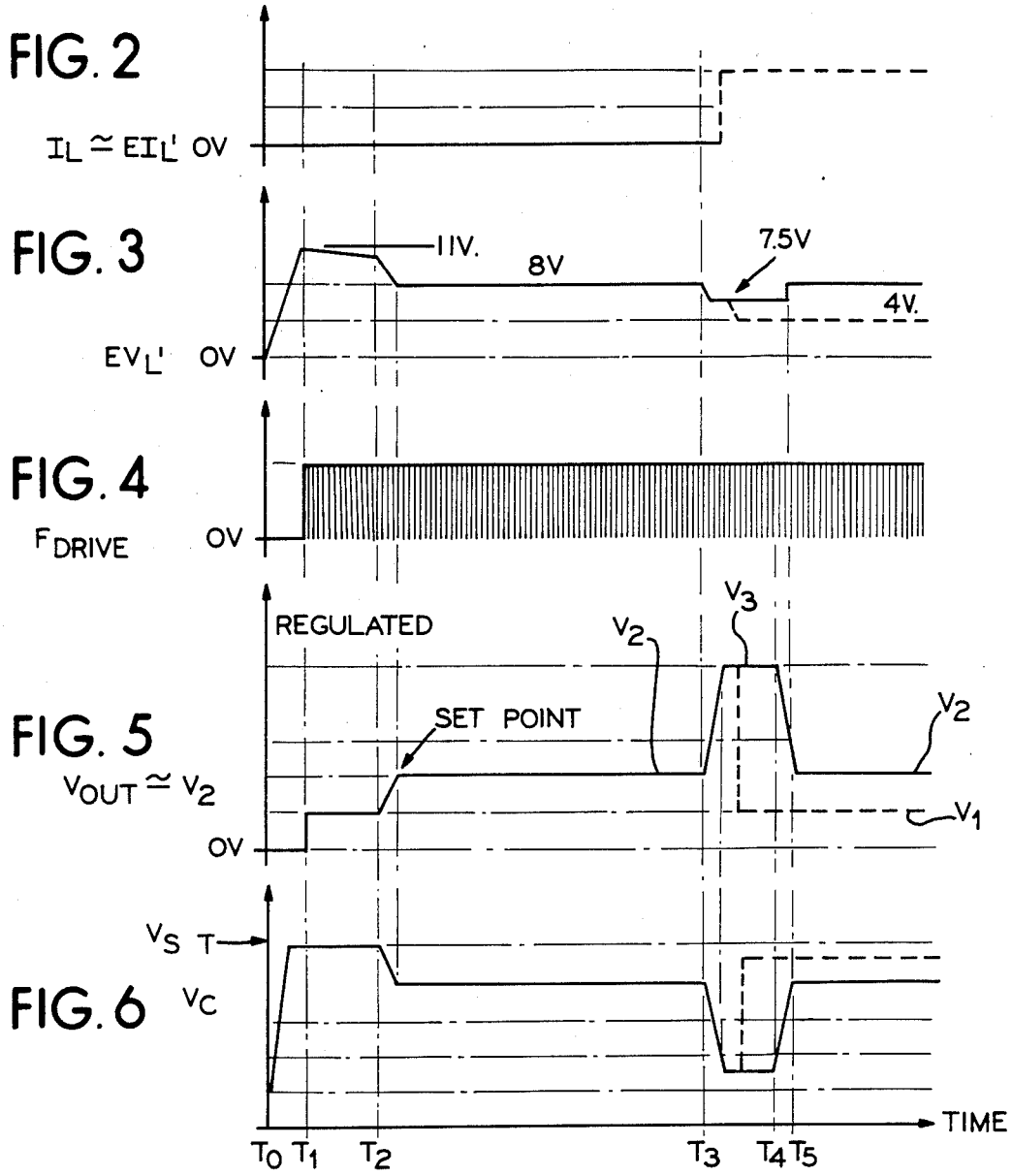
FIG. 7
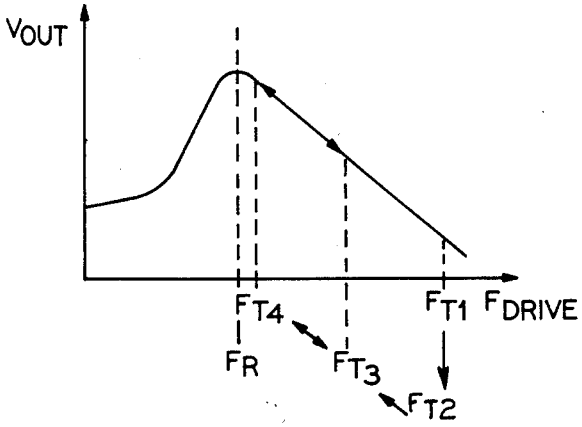
FIG. 8
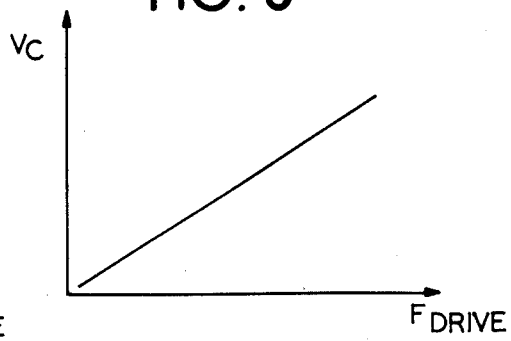

FLUORESCENT LAMP CIRCUIT WITH REGULATION RESPONSIVE TO VOLTAGE, CURRENT, AND PHASE OF LOAD

CROSS-REFERENCE TO RELATED PATENT AND APPLICATION

This application is related to but in no way dependent upon U.S. Pat. No. 4,477,748, which issued Oct. 16, 1984 to Thomas Industries Inc. as assignee of Calvin E. Grubbs, co-pending patent application Ser. No. 661,397, filed Oct. 16, 1984, and now abandoned, entitled "Improved Electronic Ballast Circuit Fluorescent Lamps", in the name of Calvin E. Grubbs, and to U.S. Ser. No. 845,853, filed Mar. 28, 1986, and now abandoned, entitled "High Frequency Ballast For Gaseous Discharge Lamps", in the names of Thomas E. Dean, William H. Henrich, David M. Fischer and Lawrence J. Stratton, the subject matter of which is incorporated by reference herein in its entirety.

BACKGROUND OF THE INVENTION

This invention relates generally to fluorescent lamps and is particularly directed to an improved fluorescent lamp start-up circuit.

The operation of most fluorescent lamps in use today which are operated at standard frequencies, i.e., 50–60 Hz, is controlled by an electromagnetic type of ballast. The ballast initiates and sustains lamp operation over a wide range of operating and use conditions. There are primarily three different approaches used for initiating fluorescent lamp operation which are referred to as switch start, instant start, and rapid start. Switch start ballasts typically preheat the lamp electrodes during the starting process, but do not apply any supplementary cathode heating once steady state lamp operation is realized. Instant start ballasts take another approach in that, while they also do not provide supplementary cathode heating during steady state operation, this type of ballast provides no electrode preheating prior to start up. Instant start ballasts depend solely upon the application of a high voltage across the lamp electrodes to provide the necessary starting and operating conditions.

The most common technique and the present trend in both magnetic and electronic ballasts for starting fluorescent lamps makes use of the rapid start approach. In this approach, the lamp and cathode voltages are increased to a fixed, predetermined voltage level which is maintained until the lamp ignites. Rapid start ballasts typically have separate cathode voltage windings integral with their design to allow the lamp electrodes to be heated during start-up and to remain heated during normal, steady state operation. This technique relies upon a balance of both cathode voltage and lamp voltage wherein the lamp voltage is typically raised to a value which will not start the lamp until the cathode is heated to a predetermined temperature. The lamp voltage is therefore limited to a peak voltage which will not cause the lamp to ignite too soon, while the cathode voltage is inversely proportional to the time it takes for the cathode to be heated to a predetermined temperature. The lamp starting time is therefore a function of both the lamp and cathode voltages.

This rapid start approach for initiating the operation of fluorescent lamps suffers from various limitations and is characterized by several undesirable operating characteristics. For example, the lamp voltage required to ignite a fluorescent lamp is a function of the type of fluorescent lamp, its operating temperature and age, and the fixture within which the lamp is incorporated. In addition, similar fluorescent lamps of the same type produced by different manufacturers typically exhibit different lamp voltage ratings and operating characteristics. The interdependence of the lamp and cathode voltages requires a delicate balancing between these two operating parameters in a rapid start ballast. When the ballast is of the electronic type, leakage to the fixture as well as through the lamp tends to upset the balance between these two operating voltages making rapid start operation of the fluorescent lamps even more difficult to achieve.

The present invention avoids the aforementioned difficulties of the prior art by applying the lamp and cathode voltages in a predetermined, timed manner for reliably initiating operation of fluorescent lamps of various types and manufacturing brands having a wide range of operating temperature and wattage requirements.

OBJECTS AND SUMMARY OF THE INVENTION

Accordingly, it is an object of the present invention to provide for improved start-up in a fluorescent lamp.

It is another object of the present invention to increase fluorescent lamp life by substantially reducing lamp electrode sputtering during lamp start-up.

Another object of the present invention is to apply inter-electrode and cathode heating voltages in a fluorescent lamp so as to provide more reliable and safer lamp start-up.

A further object of the present invention is to provide a fluorescent lamp arrangement which permits the lamp filament voltage to be reduced or even turned off following lamp start-up for reducing input power consumption while retaining full, rated lamp life.

A still further object of the present invention is to provide for controlled cathode pre-heating in a fluorescent lamp followed by automatic, timed application of a starting pulse sufficient to ignite lamps having a wide range of design parameters and operating characteristics.

The present invention contemplates an arrangement for applying a lamp voltage in a fluorescent lamp at a level well below the voltage required to ignite the lamp in any fixture at any normal temperature. The lamp cathode is then heated to a temperature which is sufficient to prevent cathode sputtering and the resulting shortening of lamp life. After the cathode is heated for a predetermined time period determined by the value of the cathode voltage for different fluorescent lamp designs and manufacturing types, the lamp voltage is then raised to a voltage well in excess of the ignition voltage required for all lamp designs, manufacturer types, etc. Following application of this lamp ignition voltage, which is applied in a pulsed manner, the fluorescent lamp is ignited in a safe, reliable manner.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with accompanying drawings, in which:

FIGS. 2-6 illustrate the timing of various signals within the fluorescent lamp start-up circuit of FIG. 1;

FIG. 7 is a graphical representation of the transfer function of the fluorescent lamp start-up circuit of FIG. 1 illustrating the output voltage provided to a fluorescent lamp as a function of the output signal frequency of the start-up circuit; and FIG. 8 illustrates the variation of output signal frequency with the input voltage provided to a voltage controlled oscillator in the fluorescent lamp start-up circuit of FIG. 1.

DETAILED DESCRIPTION OF THE PREFERRED EMBODIMENT

Figure 1:
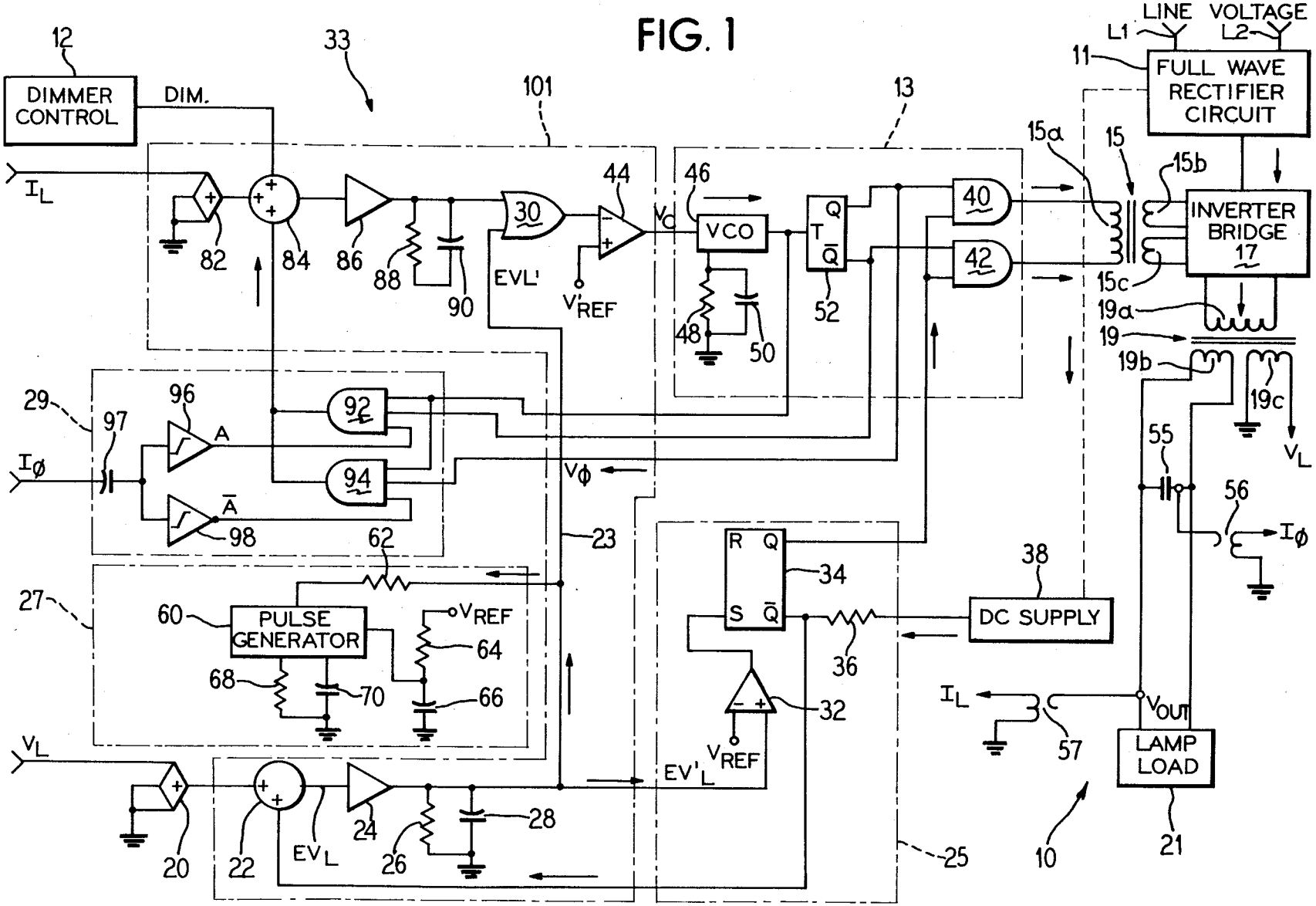
FIG. 1 is a simplified combined schematic and blocked diagram of an improved start-up circuit for use with a fluorescent lamp in accordance with the present invention.

Referring to FIG. 1, there is shown in combined schematic and block diagram form an improved fluorescent lamp start-up circuit 10 in accordance with the present invention. The start-up circuit 10 is coupled to and provides drive signals to the combination of a drive transformer 15, an inverter bridge circuit 17, an output transformer 19, and thence to a lamp load, or fluorescent lamp 21. A full-wave rectifier circuit 11 receives standard line power, e.g., 60 Hz, via lines L1 and L2 and converts it to a full-wave rectified output signal. The rectified output signal is then provided to the inverter bridge 17 which may be conventional in design and operation. An inverter bridge circuit 17 which may be used with the fluorescent lamp start-up circuit 10 of the present invention is described in the aforementioned, related patent and patent application and may include first and second power MOSFETs, which are not shown in the figure. A series resistance/capacitance circuit (not shown) is connected across each MOSFET to limit the rate of change of voltage. Since such circuits are known in the art, being commonly referred to as "snubber" circuits, the details of the inverter bridge 17 are not provided herein.

The inverter bridge 17 provides a high frequency output signal for driving a fluorescent lamp. Operation of the inverter bridge 17 is under the control of a timing and feedback control circuit 33. The MOSFETs in the inverter bridge 17 are gated "on" by a signal coupled through the drive transformer 15 from the timing and feedback control circuit 33. The drive transformer 15 includes a primary winding **15*a* driven by the timing and feedback control circuit 33, and first and second secondary windings 15*b*, 15*c* which are connected in circuit respectively with the gate lead of one of the aforementioned MOSFETs in such a manner that current flowing through the primary winding 15*a* of the drive transformer 15** in one polarity causes a first MOSFET to conduct, and current flowing through the primary winding in the opposite polarity causes the second MOSFET to conduct.

The timing and feedback control circuit 33 is coupled directly to the primary winding **15*a* of the drive transformer 15. Conventional voltage supply and regulating circuitry (not shown) is provided to the timing and feedback control circuit 33 for logic and control power for the timing and feedback control circuit. One example of a timing and feedback control circuit 33 for use with the start-up circuit 10** of the present invention can be found in the aforementioned cross-referenced patent application.

A diagonal branch of the inverter bridge circuit 17 includes a primary winding **19*a* of the output transformer 19. The primary winding 19*a* is electromagnetically coupled to a plurality of secondary windings generally designated 19*b* and 19*c* in the output transformer 19 for generating various control signals in controlling various operating parameters of the fluorescent lamp. These control signals may include, but are not necessarily limited to, a lamp current ($I_L$), lamp voltage ($V_L$), and resonant capacitor current phase signal ($I_\phi$) While FIG. 1 illustrates the various aforementioned control signals being derived from the secondary windings 19*b* and 19*c* of the output transformer 19, some lamp load circuits may include a plurality of such transformers from which various of the aforementioned control signals are derived. However, for simplicity, all of the aforementioned control signals in the fluorescent lamp 21 are shown as derived from various secondary windings of the power transformer 19. For example, $V_L$ in a preferred embodiment is derived directly from secondary winding 19*c* while $I_L$ is derived from secondary winding 19*b* via a current transformer 57**. $I_\phi$is derived as described below.

In accordance with the present invention, the aforementioned control signals, $I_L$, $I_\phi$, and $V_L$, are provided to the timing and feedback control circuit 33. The timing and feedback control circuit 33 includes a power-up reset circuit 25, a start-pulse generator 27, a phase limiter 29, an error amplifier 101, and a drive signal controller 13, Briefly, the power-up reset circuit 25 introduces a time delay in the drive signal controller 13 following receipt of a DC voltage by the start-up circuit 10 from a direct voltage supply 38 to allow for the stable operation of the direct voltage supply prior to operation of the inverter bridge 17. The start-pulse generator circuit 27 provides a start-up pulse having a predetermined width and voltage level in the timing and feedback control circuit 33 for initiating the operation of the fluorescent lamp 21. The timing and feedback control circuit 33 provides a pulsed signal to the inverter bridge 17 for alternately driving the two aforementioned MOSFETs therein. The timing and feedback control circuit 33 regulates the voltage provided to the fluorescent lamp 21 during lamp start-up and regulates the current poovided to the fluorescent lamp during normal or steady state operation of the fluorescent lamp. A dimmer control circuit 12 may be coupled to the timing and feedback control circuit 33 for providing a variable current input thereto in allowing for the dimming of the fluorescent lamp as desired. The dimmer control circuit 12 may employ pulse width modulation or some other conventional control scheme by providing a DC level voltage to the summing node 84 of the timing and feedback control circuit 33 for fluorecent lamp dimming. The phase limiting circuit 29 is coupled in the timing and feedback control circuit 33 in a feedback arrangement and is responsive to the phase angle of the current and voltage of the resonant capacitor 55 by limiting the minimum frequency of the control and feedback circuit 33 to the resonant frequency of the LC tank circuit comprised of secondary winding 19*b* and capacitor 55. A detailed description of each of the aforementioned elements of the fluorescent lamp start-up circuit 10 is provided in the following paragraphs.

A DC input voltage is provided from the DC supply 38 to the power-up reset circuit 25. The DC input voltage is divided-down by resistor 36 and is provided to an R-S flip-flop circuit 34 and to one input of a voltage summing circuit 22 within the error amplifier 101. To the other input of the summing circuit 22 is provided the lamp voltage ($V_L$) via a first rectifying bridge circuit 20. The summing circuit 22 adds the two aforementioned inputs provided thereto and provides a DC output $EV_L$ to an amplifier 24. The amplifier 24 in combination with the grounded parallel arrangement of resistor 26 and capacitor 28 amplifies and integrates the $EV_L$ signal to provide a level DC signal $EV_L'$ to one input of OR gate 30 and to one input of comparator 32. Comparator 32 compares $EV_L'$ with a reference voltage ($V_{REF}$) and either provides an input or does not provide an input to the S-input pin of the R-S flip-flop 34 as a result of this comparison. When the DC supply 38 comes up, it applies a high level to the $\overline{Q}$ output of the R-S flip-flop 34 resulting in the resetting of the flip-flop and a Q=0 output therefrom. The state of an R-S flip flop may be set when the R-S flip flop is first energized by driving the desired high output with a current source. The DC supply 38 and resistor 36 form such a current source and is applied initially to the $\overline{Q}$ output thus placing the $\overline{Q}$ output high and the Q output low. The Q output from the flip-flop 34 is provided to one input of each of AND gates 40 and 42 in the drive signal controller 13. With Q=0, AND gates 40 and 42 will have no output and the disabled drive signal controller 13 will not provide drive signals to the drive transformer 15. As the DC supply 38 comes up, integrator capacitor 28 starts charging and raising $EV_L'$. When the $EV_L'$ input to the plus input pin of the comparator exceeds $V_{REF}$, the flip-flop 34 is switched to the set condition. With flip-flop 34 thus set, its Q output goes high enabling AND gates 40 and 42. Thus, AND gates 40 and 42 are enabled following a predetermined time delay after initiation of operation of the DC supply 38, with the time delay determined by the RC time constant of resistors 26, 36 and capacitor 28. This time delay is of such length that the DC supply 18 has already initialized the R-S flip flop 34 before $EV_L'$ exceeds the $V_{ref}'$. The low voltage DC supply 38 is a separate circuit which develops a 12 volt DC level to operate the low voltage logic.

The amplified, integrated voltage $EV_L'$ is also provided to one input of an OR gate 30 within the error amplifier 101. Also provided to the error amplifier 101 via a second bridge circuit 82 is the rectified lamp current $I_L$. The rectified lamp current $I_L$ is provided to one input of a current summing circuit 84, to another input of which is provided a dimming signal from the dimmer control circuit 12. The dimmer control circuit 12 provides a selectively variable DC signal to the current summing circuit 84 as described above. Also provided to one input of the current summing circuit 84 is a phase limiting signal from the phase limiting circuit 29 described in detail below.

The summed output of the current summing circuit 84 is provided to the combination of an amplifier 86 and the parallel combination of a grounded resistor 88 and capacitor 90 to provide an amplified, level DC signal to one input of OR gate 30. To the other input of OR gate 30 is provided the amplified, integrated $EV_L'$ voltage within the error amplifier 101. The higher of the two inputs to OR gate 30 controls its output such that initially upon start-up, the output of the OR gate is controlled by its $EV_L'$ input, while after start-up and upon the fluorescent lamp attaining steady state operation, the output of 0R gate is controlled by the DC level provided to its other input from the combination of amplifier 86 and grounded resistor 88 and capacitor 90. OR gate 30 thus functions to control the voltage applied to the fluorescent lamp during start-up and the current provided to the fluorescent lamp during steady state operation. The output of OR gate 30 is provided to the inverting input of a differential amplifier 44, while to the noninverting input of the differential amplifier is provided a reference voltage $V_{REF}$. During start-up, capacitor 28 becomes charged to a level so as to maintain differential amplifier 44 in saturation. Differential amplifier 44 is maintained in saturation for a period determined by the time constant associated with the discharge of capacitor 28 via resistor 26 and by its own leakage. In a preferred embodiment, this time interval is 10 milliseconds during which differential amplifier 44 is maintained in saturation. This permits the timing and feedback control circuit 33 to stabilize before regulation is achieved.

The $V_C$ output from the differential amplifier is thus related to the lamp start-up voltage during system start-up and to the lamp current following start-up after steady state fluorescent lamp operation is attained. The $V_C$ output from the differential amplifier 44 is provided to a voltage controlled oscillator (VCO) 46, the frequency of which is controlled by the value of $V_C$. Thus, as $V_C$ increases, the operating frequency of the VCO 46 increases, while as $V_C$ decreases, the operating frequency of the VCO undergoes a corresponding decrease as shown in FIG. 8. Coupled to the VCO 46 is a parallel, grounded arrangement of resistor 48 and capacitor 50 which establishes the operating frequency range of the VCO. Thus, a pulsed output having a given frequency is provided from the VCO 46 to the T-input pin of a toggle type flip-flop 52. The Q and $\overline{Q}$ outputs from the toggle type flip-flop 52 are alternately rendered active in response to the pulsed, timed output from the VCO 46. With a high Q enable output from R-S flip-flop 34 provided to AND gates 40 and 42, a high Q output from flip-flop 52 will result in a high output from AND gate 40 to one power switch (MOSFET) within the inverter bridge 17. Similarly, a high $\overline{Q}$ output from flip-flop 52 will cause AND gate 42 to provide a high output to the other power switch. In this manner, AND gates 40 and 42 alternately provide drive signals to the power switches for controlling the operation of the inverter bridge 17 and initiating start-up and controlling the steady state operation of the fluorescent lamp.

The start-pulse generator circuit 27 is coupled to line 23 by means of which the $EV_L'$ voltage is provided to OR gate 30 within the error amplifier 101. The start-pulse generator circuit 27 operates in the following manner to provide a high voltage start pulse to the fluorescent lamp via the timing and feedback control circuit 33 and inverter bridge 17. The start-pulse generator circuit 27 includes a pulse generator 60 which is coupled to line 23 via a current limiting resistor 62. The pulse generator 60 is also coupled to neutral ground potential via the parallel combination of resistor 68 and capacitor 70 and is further coupled to a reference voltage $V_{REF}$ via the combination of resistor 64 and grounded capacitor 66. The pulse generator 60 is conventional in design and operation and in a preferred embodiment includes a bi-polar transistor (not shown) coupled to resistor 62 so as to operate as an open collector device. Pulse generator 60 functions as a switch to periodically lower the potential of line 23 and the $EV_L'$ input voltage in the error amplifier 101. Thus, the pulse generator 60 is periodically rendered conductive to ground resistor 62. The RC time constant of resistor 64 and capacitor 66 establishes the delay before start of the pulse generator 60. The RC time constant of the combination of resistor 68 and capacitor 70 establishes how long the pulse generator 60 is rendered conductive or the pulse width and the pulse repetition rate. Thus, capacitor 28 has a parallel discharge path through resistor 62 such that during conductive periods of the pulse generator 60, $EV_L'$ and $V_C$ are pulled down causing an output voltage spike to appear across the fluorescent lamp load circuit at a rate determined by the pulse rate as established by resistor 68 and capacitor 70 and a height determined by resistor 62. In a preferred embodiment, resistor 64 and capacitor 66, which form a delay network, hold the pulse generator 60 disabled for approximately 0.6 seconds to allow the lamp filament to heat to the proper operating temperature. Following ignition of the fluorescent lamp, lamp current is controlled as described in the following paragraph.

Phase limiting is accomplished by means of the phase limiting circuit 29 within the drive signal controller 33. The phase limiting circuit 29 includes a pair of AND gates 92 and 94 respectively coupled to the Q and $\overline{Q}$ outputs of the toggle type flip-flop 52. The Q and $\overline{Q}$ outputs of flip-flop 52 are in phase with the output voltage. Also provided to respective inputs of AND gates 92 and 94 is the pulsed output of the VCO 46. The resonant tank current phase angle signal $I_\phi$ is provided to the phase regulator circuit 29 from a tank circuit comprised of capacitor 55 and current transformer 56 coupled to the output transformer 19. $I_\phi$ is provided via coupling capacitor 97 to an amplifier 96 and to an inverter 98. The output A of amplifier 96 is provided to one input of AND gate 92, while the output $\overline{A}$ of inverter 98 is provided to one input of AND gate 94. The timing of the complementary signals A and $\overline{A}$ respectively output from amplifier 96 and inverter 98 corresponds with the phase of the fluorescent lamp current $I_L$, while the timed Q and $\overline{Q}$ outputs of flip-flop 52 correspond to the phase of the voltage of the drive signals provided from the drive signal controller 13 to the inverter bridge 17. When $V_L$ and $I_L$(the voltage and current) are in phase, AND gates 92 and 94 will provide outputs to the summing circuit 84 in an alternating manner upon receipt of a pulse from the VCO 46.

As $V_\phi$ and $I_\phi$ get closer and closer in phase, the pulse width of the signals within this current loop increases so as to make it appear as if there is more current within the lamp than there actually is. The increased pulse width raises the frequency $F_{DRIVE}$ of the drive signals provided through the timing and feedback control circuit 33 and reduces the voltage ($V_{OUT}$) and current of the drive signals. It is in this manner that the drive signals provided from the timing and feedback control circuit 33 are frequency limited so as to limit the minimum frequency to a frequency just higher or at the resonant frequency of the LC tank circuit, after initiation of operation and during normal steady state operation of the fluorescent lamp.

Referring to FIGS. 2–6, there is shown the timing of various signals within the fluorescent lamp start-up circuit 10 of FIG. 1. Between time $T_o$ and $T_1$ capacitor 28 is being charged by the $EV_L$ output from the summing circuit 22. When the voltage on capacitor 28 is equal to or greater than the $V_{REF}$ input to comparator 32, the output of the comparator goes high resulting in the setting of flip-flop 34 which then provides a high Q output to AND gates 40 and 42 which are thereby enabled. The time interval from $T_o$ to $T_1$ is determined by the RC time constant of resistors 26 and 36 and capacitor 28. Shortly after $T_1$, capacitor 28 is charged to a voltage level which maintains amplifier 44 in saturation ($V_{SAT}$). Between time $T_1$ and $T_2$, capacitor 28 discharges through resistor 26 to ground and also by its own leakage, with the time constant sufficient to hold amplifier 44 in saturation for a predetermined period, i.e., 10 milliseconds in a preferred embodiment. This permits the timing and feedback control circuit 33 as well as the inverter bridge 17 to stabilize. Shortly after $T_2$, amplifier 44 is no longer in saturation and the output voltage $V_{OUT}$ is increased to a regulated setpoint as shown in FIG. 5 and labeled $V_2$. Output voltage regulation is accomplished when $V_L$ increases and supplies a voltage level to the first summing circuit 22. This reduced voltage is then applied to OR gate 30, to amplifier 44 and then as $V_C$ to the input of the VCO 40 for reducing its frequency of oscillation.

As indicated above and as illustrated in FIG. 8, the transfer function of VCO 46 is such that as $V_C$ decreases, the drive frequency decreases and, as shown in the output voltage transfer function illustrated in FIG. 7, as the drive frequency decreases, the lamp voltage increases at frequencies above the resonant frequency $F_R$ of the inverter bridge 17. Thus, the output lamp voltage $V_{OUT}$ is regulated to a setpoint that is determined by $V_C$ with the proportionality constant of $V_{OUT}$ to $V_L$ shown in FIG. 5. The regulated setpoint (voltage level $V_2$) is preferably on the order of 400 volts peak. A regulated setpoint for $V_{OUT}$ of 400 volts peak is not sufficient to initiate fluorescent lamp operation under normal conditions. The pulsed operation of the pulse generator 60 results in the momentary pulling down of the $V_C$ input to the VCO 46 as previously described at $T_3$ as illustrated in FIG. 6. Pulling down $V_C$ following $T_3$ causes an output voltage spike, voltage level labeled $V_3$ in FIG. 5, which in a preferred embodiment is approximately 800 volts peak, to appear across the fluorescent lamp at a rate determined by the pulse rate set by the values of resistor 68 and capacitor 70 of the pulse generator 60 with the pulse height determined by the value of resistor 62. The pulse generator 60 is rendered disabled for a period determined by the RC time constant of resistor 64 and capacitor 66, which in a preferred embodiment is approximately 0.6 seconds, in establishing the pulse width. This time interval is determined based upon the time required to allow the fluorescent lamp filaments to heat to their normal operating temperature. A voltage spike $V_3$, such as shown in FIG. 5 causes fluorescent lamp ignition under normal conditions and following $T_5$ the lamp operates normally at the voltage $V_1$, for example. If the fluorescent lamp does not ignite, the pulses will be repeated at a rate determined by resistor 68 and capacitor 70. $F_{DRIVE}$ illustrated in FIG. 4 represents the frequency of the drive signal provided from AND gates 40 and 42 to the inverter bridge 17 during fluorescent lamp start-up. The dotted line portions of the signals illustrated in FIGS. 2–6 represent signal values following fluorescent lamp start-up and during steady state lamp operation.

Thus, fluoroescent lamp operation is sustained by application of first voltage $V_1$ across the flourescent lamp electrodes by the inverter circuit, second voltage $V_2$ is provided to the fluorescent lamp electrodes for the heating thereof, and third voltage $V_3$ is provided to the fluorescent lamp electrodes for initiating operation of the fluorescent lamp, where $V_3$ is greater than $V_1$ as shown in FIG. 5.

There has thus been shown a fluorescent lamp start-up circuit which initially applies a lamp voltage not sufficient to start the fluorescent lamp while the lamp cathode is being heated for a predetermined time period. Once the cathode has been brought up to operating temperature, the lamp voltage is then rapidly increased to a value well in excess of the ignition voltage required for all lamp types and operating characteristics in initiating fluorescent lamp operation. A fluorescent lamp dimming capability is available and a start-up delay period is provided to allow for stabilized start-up circuit operation prior to fluorescent lamp ignition.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A start-up circuit energized by a direct voltage source for driving an inverter circuit coupled to a fluorescent lamp having a plurality of electrodes for initiating operation of the fluorescent lamp, wherein fluorescent lamp operation is sustained by application of a first voltage $V_1$ across the fluorescent lamp electrodes by the inverter circuit said start-up circuit comprising: power-up circuit means coupled to the direct voltage source for generating a power-up signal; drive signal control means coupled to the inverter circuit and to said power-up signal for providing first drive signals to the inverter circuit to provide a second substantially constant voltage $V_2$ to the fluorescent lamp electrodes for the heating thereof for a predetermined period of time; and pulse generating means coupled to said drive control means and to said power-up circuit means and responsive to said power-up signal for generating a high voltage start-up pulse following receipt of said power-up signal and for providing said start-up pulse to said drive signal control means, whereupon said drive signal control means provides second drive signals to the inverter circuit to provide a third voltage $V_3$ to the fluorescent lamp electrodes for initiating the operation of the fluorescent lamp, where $V_3 > V_1$ and where $V_3 > V_2$.

2. The start-up circuit of claim 1 further comprising first feedback means coupling said power-up circuit means to the fluorescent lamp for providing a lamp voltage signal to said power-up circuit means and wherein said drive signal control means regulates the lamp voltage by controlling said first drive signals during fluorescent lamp start-up.

3. The start-up circuit of claim 2 further comprising second feedback means coupling the fluorescent lamp to said drive signal control means for providing a lamp current signal thereto and wherein said drive signal control means regulates the lamp current by controlling said first drive signals following fluorescent lamp start-up.

4. The start-up circuit of claim 1 wherein said pulse generating means includes timing means for delaying the providing of said second drive signals to the inverter circuit and thus the providing of the third voltage $V_3$ to the fluorescent lamp electrodes for a predetermined time period.

5. The start-up circuit of claim 4 wherein said timing means includes an RC network and said predetermined time period is established by an RC time constant thereof.

6. The start-up circuit of claim 1 wherein said predetermined time period is a minimum of 0.6 second.

7. The start-up circuit of claim 1 wherein said power-up circuit means includes enable signal generating means for generating and providing an enable signal to said drive signal control means following receipt by said power-up circuit of a direct voltage from the direct voltage source.

8. The start-up circuit of claim 7 wherein said enable signal generating means includes timing means for delaying the providing of said enable signal to said drive signal control means a predetermined time period following receipt by said power-up circuit of a direct voltage from the direct voltage source.

9. The start-up circuit of claim 8 wherein said timing means includes an RC network and said predetermined time period is established by an RC time constant of said network.

10. The start-up circuit of claim 1 wherein said drive signal control means includes a feedback control network for regulating drive signals provided to the inverter circuit and the fluorescent lamp current following fluorescent lamp start-up.

11. An electronic circuit for initiating and sustaining operation of a fluorescent lamp having a plurality of electrodes from a source of electrical power having a voltage amplitude varying in time, wherein fluorescent lamp operation is initiated by application of a first voltage $V_1$ across the fluorescent lamp electrodes, comprising: inverter circuit means receiving power from said source and including first and second controlled switches gated to conduction respectively in alternate cycles of inverter frequency for generating a high frequency electrical signal for supplying power to the fluorescent lamp; sensing circuit means for generating a control signal representative of lamp current; feedback control circuit means for controlling the gating of said controlled switches in response to said control signal for regulating lamp current to a predetermined value in sustaining fluorescent lamp operation; power-up circuit means energized by said source for providing a second voltage substantially constant voltage $V_2$ to the fluorescent lamp via said feedback control circuit and said inverter circuit means prior to the operation of the fluorescent lamp for heating the electrodes of the fluorescent lamp to an operating temperature; and pulse generating means coupled to said feedback control circuit means and to said power-up circuit means for providing a third voltage $V_3$ via said feedback control circuit means and said inverter circuit means to the fluorescent lamp for initiating operation of the fluorescent lamp following a predetermined time interval after receipt of said second voltage $V_2$ by said feedback control circuit means, where $V_3 > V_1$ and where $V_3 > V_2$.

12. A start-up circuit energized by a direct voltage source for driving an inverter circuit coupled to a fluorescent lamp having a plurality of electrodes for initiating operation of the fluorescent lamp, wherein fluorescent lamp operation is sustained by application of a first voltage $V_1$ across the fluorescent lamp electrodes by the inverter circuit, said start-up circuit comprising: power-up circuit means coupled to the direct voltage source for generating a power-up signal; drive signal control means coupled to the inverter circuit and to said power-up signal for providing first drive signals to the inverter circuit to provide a second substantially constant voltage $V_2$ to the fluorescent lamp electrodes for the heating thereof for a predetermined time period; and pulse generating means coupled to said drive signal control means and to said power-up circuit means and responsive to said power-up signal for generating a high voltage start-up pulse following receipt of said power-up signal and for providing said start-up pulse to said drive signal control means, whereupon said drive signal control means provides second drive signals to the inverter circuit to provide a third substantially constant voltage $V_3$ to the fluorescent lamp electrodes for initiating the operation of the fluorescent lamp, where $V_3 > V_1$.

* * * * *